United States Patent [19]

Matsui et al.

[11] Patent Number: 4,548,403

[45] Date of Patent: Oct. 22, 1985

[54] SORTER

[75] Inventors: Toshio Matsui; Yasuhiro Doi; Keichi Kinoshita; Kuniaki Ishiguro, all of Toyokawa, Japan

[73] Assignee: Minolta Camera Kabushiki Kaisha, Osaka, Japan

[21] Appl. No.: 442,434

[22] Filed: Nov. 17, 1982

[30] Foreign Application Priority Data

| | | | |
|---|---|---|---|
| Nov. 18, 1981 | [JP] | Japan | 56-185775 |
| Apr. 26, 1982 | [JP] | Japan | 57-60858[U] |
| May 7, 1982 | [JP] | Japan | 57-77215 |
| May 19, 1982 | [JP] | Japan | 57-74151[U] |
| Jun. 3, 1982 | [JP] | Japan | 57-83318[U] |
| Jun. 16, 1982 | [JP] | Japan | 57-90414[U] |

[51] Int. Cl.[4] ..... B65H 39/11; B65H 29/12

[52] U.S. Cl. ..... 271/296; 74/575; 198/814; 271/302

[58] Field of Search ..... 271/296, 302, 271, 273; 198/364, 814, 859, 457, 836; 74/527, 575, 577 R

[56] References Cited

U.S. PATENT DOCUMENTS

| | | | |
|---|---|---|---|
| 3,372,922 | 3/1968 | Snellman et al. | 271/296 |
| 3,414,256 | 12/1968 | Mestre | 271/296 |
| 3,604,321 | 9/1971 | Shellman et al. | 93/93 C |
| 3,937,459 | 9/1974 | Lawrence | 271/173 |
| 4,170,349 | 10/1979 | Baumann et al. | 271/296 |
| 4,322,069 | 3/1982 | Mitchell | 271/296 |
| 4,346,881 | 8/1982 | Frye | 271/188 |
| 4,373,712 | 2/1983 | Mitzel | 271/275 |

*Primary Examiner*—Bruce H. Stoner, Jr.
*Assistant Examiner*—John A. Carroll
*Attorney, Agent, or Firm*—Wenderoth, Lind & Ponack

[57] ABSTRACT

The invention relates to a sorter of the type in which a distributor moves relative to a plurality of bins arranged fixedly along the inlets of bins to thereby distribute sheets into the bins individually, and is constituted by a pair of belts for transporting the sheet received from the copying machine toward the distributor and a tensioner for tensing the belts. Another arrangement of the invention has a device for preventing the movement of the distributor in both forward and reverse direction while the distributor is at a stop. Further another arrangement of the sorter includes structure for successfully guiding the leading edge of the sheet into a pair of rollers provided the distributor.

4 Claims, 21 Drawing Figures

SORTER

FIELD OF THE INVENTION

The present invention relates to a sorter for receiving copy sheets from a copying machine and sorting or collating the sheets in a suitable order, and more particularly to a sorter of the type which includes a plurality of fixed bins for sorting sheets and in which the sheets discharged from a copying machine and sent forward by transport means are distributed into the bins by distributing means which is movable along the inlets of the bins.

BACKGROUND OF THE INVENTION

The sorters of the above type can be further divided into the following two types.

Sorters of one type, which are disclosed for example in U.S. Pat. No. 3,604,321 and U.S. Pat. No. 4,170,349, include transport means providing a path of transport of sheets along the inlets of bins, and a deflector unit serving as distributing means and movable in parallel with the path. The deflector unit includes a deflector partly positioned in the path for deflecting a forwarded sheet toward one of the bins in engagement with the sheet and guiding the sheet into the bin.

Sorters of the other type, such as the one disclosed in U.S. Pat. No. 4,322,069, comprise a movable unit having discharge rollers and movable along the inlets of bins, introducing rollers for receiving sheets from a copying machine and two endless belts reeved around the discharge rollers and the introducing rollers for sandwiching the sheet therebetween. With the sorters of this type, the transport means and the distributing means are in the form of an assembly.

Unlike high-speed sorters of large capacity having a diverting gate at the inlet of each bin, the sorters of the types described are compact and simple in construction but still have various drawbacks to be eliminated.

The sorter of U.S. Pat. No. 3,604,321 does not include means for locking the deflector unit in the position where the deflector unit is halted in a position opposed to one of the bins. The sorter of U.S. Pat. No. 4,170,349 includes only a ratchet and a dog for locking the deflector unit against movement in one direction only.

Accordingly the sorters of U.S. Pat. Nos. 3,604,321 and 4,170,349 involve the likelihood that if the apparatus temporarily stops in the event of a jam, the deflector unit will be displaced from the proper position when the operator removes the jamming sheet. If the sorter is thereafter operated with the deflector unit in the displaced position, an error will occur when the subsequent sorting operation is resumed.

The sorter of U.S. Pat. No. 4,322,069 has idle sleeves for pressing the two endless belts against the introducing rollers and the discharge rollers to hold the belts in tension, so that under a stable condition, the portions of the belts between the introducing rollers and the discharge rollers are held tensioned, while the other portions of the belts are in a free state. With this arrangement, however, the belts become relaxed when subjected to a great force between the pairs of rollers, and the relaxation will not be remedied unless the apparatus is disassembled and the belts reinstalled.

Such a great force is produced by the resistance of the sheet, for example, when the discharge rollers are the largest distance away from the introducing rollers. When the pairs of rollers are so positioned, the direction of advance of the sheet while it is being transported while held between the two belts greatly differs from the direction of advance of the sheet when it is delivered from the discharge rollers. The stiffness of the sheet produces resistance to the deflection of the sheet to the latter direction. Such resistance exerts a force on the belt to cause relaxation or permits the sheet to slip in front of the discharge rollers, possibly resulting in a jam or like failure.

Further because the portions of the belts other than those positioned between the pairs of rollers are free, the free belt portions must be accommodated in a considerably large space so as not to interfere with other members. It is therefore impossible to make the arrangement very compact.

SUMMARY OF THE INVENTION

Accordingly the main object of the present invention is to provide an improved sorter of compact and simplified construction.

Another object of the invention is to provide a sorter which is adapted to sort or collate sheets reliably.

Another object of the invention is to provide a sorter including distributing means which can be locked in position reliably when opposed to the inlets of bins.

Another object of the invention is to provide a sorter including sheet transporting belt members which can be entirely held tensioned reliably.

Still another object of the invention is to provide a sorter wherein sheets can be guided and transported to bins reliably.

The foregoing main and other objects can be fulfilled by the following sorters.

Stated specifically the present invention provides a sorter of the type in which distributing means moves relative to a plurality of bins arranged fixedly along the inlets of bins to thereby distribute sheets into the bins individually and which is characterized by a drive source for moving the distributing means along the bins, drive transmission means coupling the drive source to the distributing means and including at least one shaft, and means for preventing the shaft from rotating in both forward and reverse directions while the distributing means is at a stop.

The present invention provides another sorter of the type wherein distributing means moves relative to a plurality of bins arranged fixedly along the inlets of bins to thereby distribute sheets into the bins individually, the sorter being characterized by first roller members provided in the distributing means, second roller members fixedly provided for receiving the sheets from a copying machine, a pair of belt means reeved around the first and the second roller members for transporting each sheet held between the belt means, at least one of the belt means being an endless belt to be driven, a roller member in contact with the endless belt and supported movably in parallel with the direction of movement of the distributing means, and a biasing member for biasing the last-mentioned roller member toward a direction to hold the endless belt in tension.

Stated more specifically one of the belt means of the sorter is an endless belt member and the other belt means is a tape member having its opposite ends fixed at the positions of the first and the second roller members, the tape member being fixed at one of the positions of the roller members to a member biased into rotation so as to wind the tape member thereon.

Stated more specifically the distributing means of the second-mentioned sorter includes a guide member resting under gravity on the lower one of the pair of belt members and having a projecting portion approximately opposed to the direction of transport of the sheet for guiding the sheet toward the outlet of the distributing means.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE INVENTION

Figure 1:
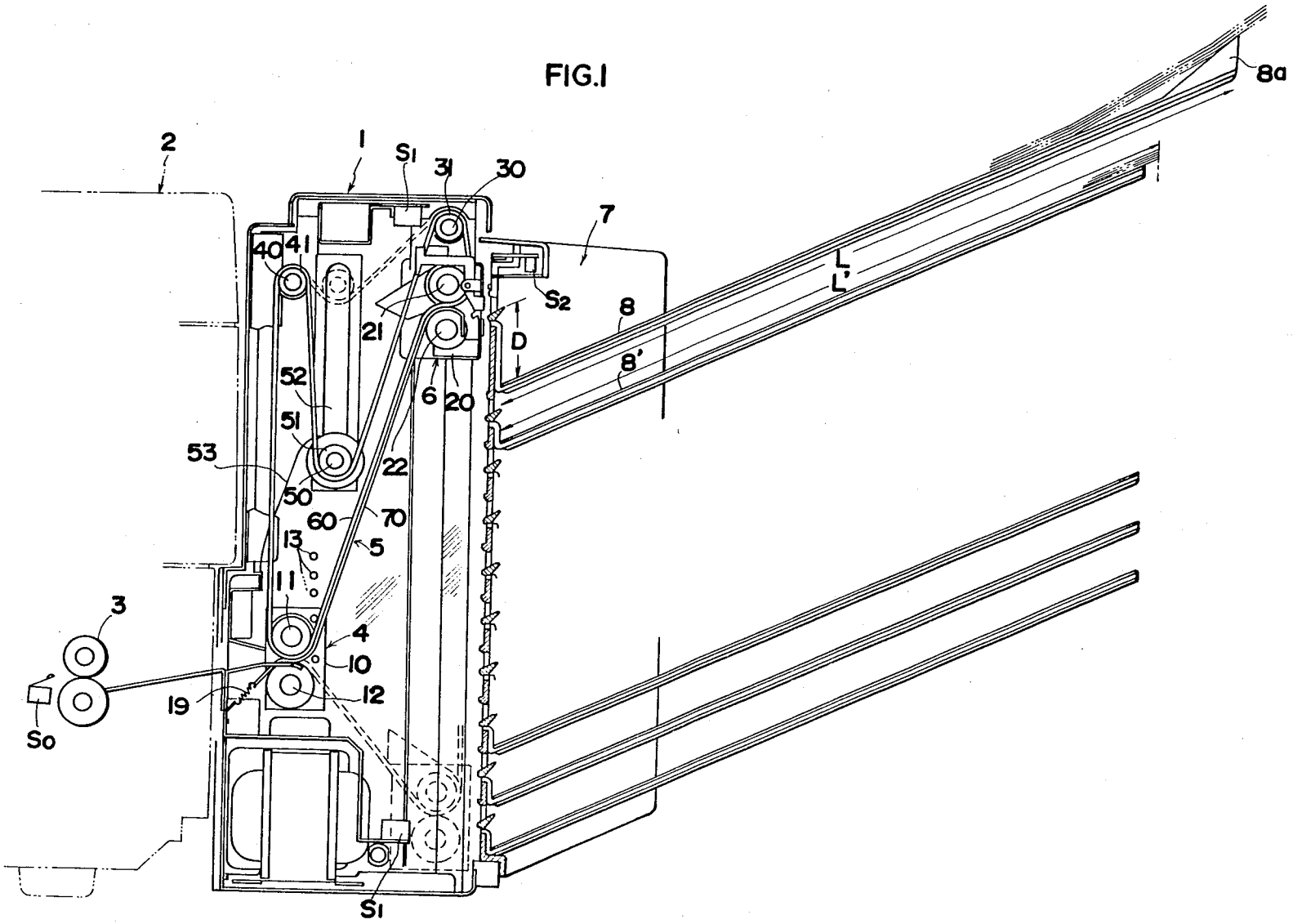
FIG. 1 is a sectional view schematically showing a sorter of the present invention as it is seen from one side thereof.

With reference to FIG. 1, a sorter 1 is attached to a copying machine 2. Sheets are delivered from a pair of outlet rollers 3 of the copying machine 2 to an introducing unit 4 first and then conveyed by transport means 5 including a pair of belt members to a discharging unit 6, by which the sheets are distributed to bins 8, 8', . . . of a bin assembly 7.

The introducing unit 4 includes a frame 10, two shafts 11, 12 supported by the frame 10 and groups of rollers mounted on these shafts. The frame 10 is fixed to the sorter with use of a suitable number (two or three) of threaded bores 13 formed in each side plate of the sorter main body. A guide plate for guiding the sheets from the copying machine 2 to the introducing unit 4 can be also fixed in a suitable position in accordance with the position of the frame 10. When the level of the introducing unit 4 is thus adjustable, the sorter can be easily attached to copying machines which may have a slightly different level of the sheet outlet.

The discharging unit 6 is movable along the outlets of the bins 8, 8', . . . , i.e. vertically in the present embodiment, by being guided by an unillustrated member. More specifically the unit 6 is so driven as to intermittently move downward from the uppermost initial position while successively stopping at each of the positions opposed to the inlets of the bins 8, 8', . . . for distributing the sheets to the bins individually and to return to the initial position after completing the intermittent movement. Like the introducing unit 4, the discharging unit 6 also includes a frame 20, two shafts 21, 22 supported by the frame 20 and groups of rollers mounted on these shafts.

The sorter further has shafts 30, 40 which are fixedly provided and a shaft 50 which is movably provided. The shafts 30, 40, 50 are provided with rollers 31, 41, 51 respectively, each shaft carrying three rollers. The movable shaft 50 is supported by the side plate, movable along a slit 52 formed in the side plate and pulled downward by a spring 53.

The pair of belt members of the transport means 5, reeved around the above-described rollers, will be described with reference to FIG. 2. The upper belt member comprises three endless belts 60, while the lower belt member comprises two tapes 70 extending from the introducing unit 4 to the discharging unit 6. The endless belts 60 and the tapes 70 are arranged alternately. The endless belts 60 are reeved around rollers 14 on the shaft 11 of the introducing unit 4, on rollers 23 on the shaft 21 of the discharging unit 6 and on the rollers 31, 41 of the fixed shafts 30, 40. The rollers 51 on the movable shaft 50 bear on the belts 60 from outside. The movable shaft 50, which is biased by the spring 53, tensions each of the endless belts 60 in its entirety and accommodates the variation of the length of the belt between the introducing unit 4 and the discharging unit 6 due to the movement of the unit 6. The endless belts 60 are driven by the rotation of the shaft 30 to which torque is delivered from the mechanism to be described later. The shaft 12 of the introducing unit 4 and the shaft 22 of the discharging unit 6 carry idle rollers 15, 24 respectively opposed to the endless belts 60.

Figure 3A:
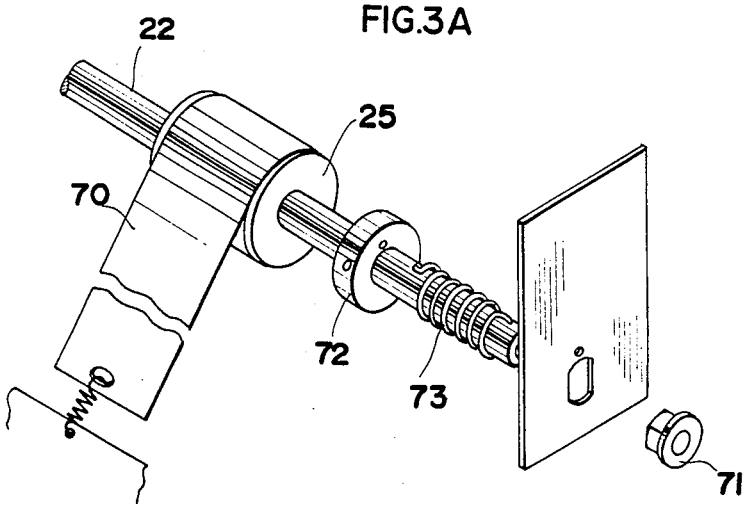
FIG. 3A is a fragmentary perspective view showing tape winding means.
Figure 3B:
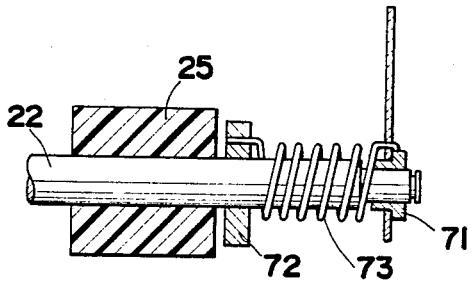
FIG. 3B is a fragmentary side elevation showing the same.

On the other hand, each of the tapes 70 is secured at its one end to the main body by a spring 19 as shown in FIG. 1, extends over the upper side of a roller 18 on the shaft 12 of the introducing unit 4 to the discharging unit 6 and is secured at the other end to a roller 25 on the shaft 22 of the unit 6. An arrangement shown in FIGS. 3A and 3B rotatingly biases the shaft 22 in a direction to wind the tape 70 around the roller 25. The shaft 22 is mounted on the side plate by a bearing 71. A spring 73 is provided between the side plate and a collar 72 fixed to the shaft 22. This arrangement accommodates the variation of the length of the belt between the introducing unit 4 and the discharging unit 6 due to the movement of the unit 6.

The sheet S is transported between the endless belts 60 and the tapes 70. During the transport of the sheet, the tapes 70 remain stationary, only guiding the sheet S which is transported by the endless belts 60. Accordingly the surfaces of the endless belts 60 must have a greater coefficient of friction than the surfaces of the tapes 70. More specifically we have found that sheets can be transported satisfactorily when the endless belts 60 are neoprene rubber belts incorporating polyester cores and having a coefficient of kinetic friction of 0.95 relative to paper, and the tapes 70 are triacetate film strips having a coefficient of kinetic friction of 0.16 relative to paper. The materials for the endless belts and the tapes are of course not limited to those mentioned above, but suitable materials are usable which satisfy the above relationship. For example, a polyester film is usable in place of the triacetate film.

The shaft 11 of the introducing unit 4 and the shaft 21 of the discharging unit 6 are respectively provided with idle rollers 16 and 26 opposed to the tapes 70. The units 4 and 6 further have pairs of rollers 17 and pairs of rollers 27 on their shafts 11, 12 and 21, 22, respectively, for assisting the transport of sheets, the rollers in each pair being in contact with each other.

Figure 4A:
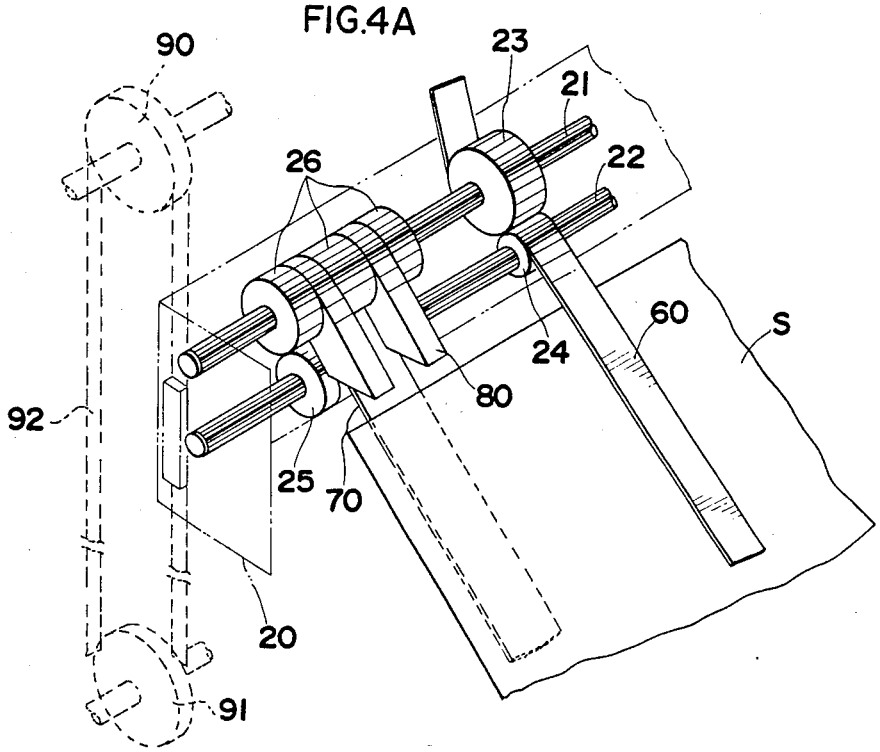
FIG. 4A is a fragmentary perspective view illustrating a guide member which is provided in a discharging unit.
Figure 4B:
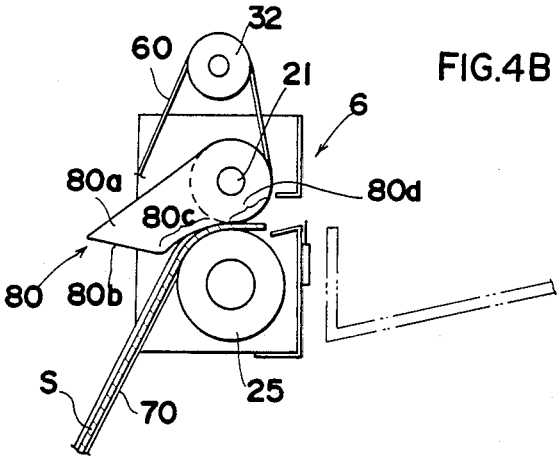
FIG. 4B and FIG. 4C are views schematically showing the guide member when the discharging unit is in an elevated position and in a lowered position respectively.
Figure 4C:
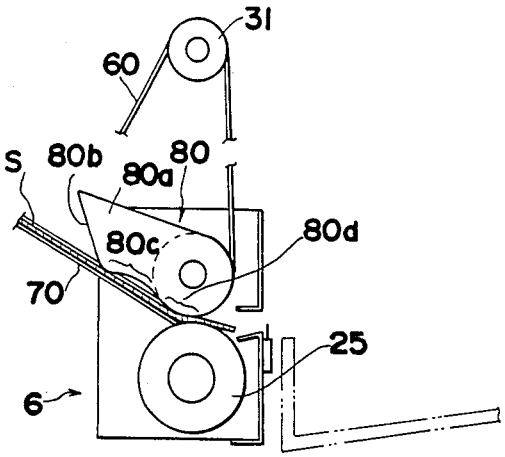

The discharging unit 6 further has the following means for the transport of sheets. FIGS. 4A, B and C show guide members 80 provided for the discharging unit 6. The guide members 80 are idly rotatably mounted on the shaft 21 at the portions thereof opposed to the tapes 70. Each guide member 80 has a projecting portion 80*a* approximately opposed to the direction of transport of the sheet and has on one side thereof facing the sheet a slanting guide portion 80*b*, a recessed guide portion 80*c* and a roll-shaped guide portion 80*d*. The leading end of the sheet sent forward, if curled, will not smoothly engage in the nip of rollers on the shafts 21, 22 of the discharging unit 6 and is likely to become folded. The slanting guide portion 80*b* acts to guide the curled portion of the sheet smoothly to the nip of rollers. The direction of advance of the sheet is the direction of the straight portions of the pair of belt members before the sheet leading end reaches the discharging unit 6 but is tangent to the rollers at their contact point when the leading end is nipped between the rollers. These two directions differ greatly when the discharging unit 6 is in its uppermost position. Accordingly the sheet leading end must be deflected greatly. The stiffness of the sheet then produces resistance to the advance of the sheet. Such resistance acts to relax the belt member or permits the sheet to slip in front of the discharging unit 6 to cause a jam. The projecting portion 80*a* of the guide member 80 rests on the tape 70 under gravity, such that the sheet leading end is smoothly deflected and led forward between the roll-shaped guide portion 80*d* and the roller 25 by the weight and the recessed guide portion 80*c*.

Figure 5:
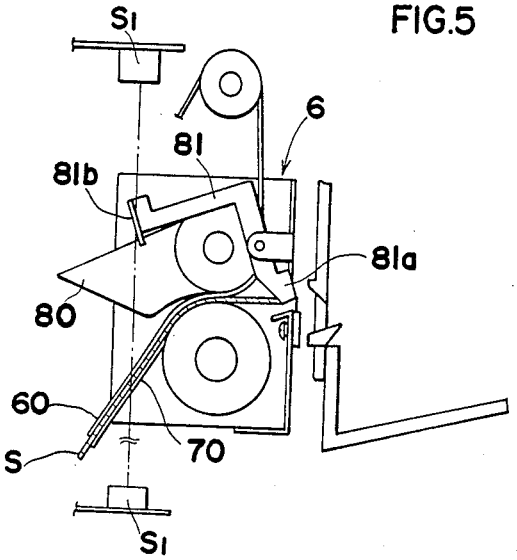
FIG. 5 is a view schematically showing an arrangement for detecting a sheet passing through the discharging unit.

The discharging unit 6 is further provided with means for detecting any sheet, for example, even a transparent sheet. As seen in FIG. 5, a lever 81 pivoted to the frame 20 has one end 81*a* projecting into the sheet outlet of the discharging unit 6. When the end 81*a* is pushed by the leading end of the sheet S sent forward, the lever 81 turns counterclockwise, bringing the other lever end 81*b* into the light path of a gate sensor S1 comprising a light-emitting element and a photocell which are disposed at an upper portion and a lower portion of the sorter. The lever end 81*b* retracts from the light path when the sheet rear end leaves the lever end 81*a*. The sheet rear end detecting signal is used for moving the discharging unit 6 to the position of the next bin. The optical gate sensor S1 provided on the sorter main body has the advantage that there is no need to provide wiring for the discharging unit 6. However, the optical sensor S1 is unable to detect a transparent sheet if used singly, so that the present embodiment has the lever 81 which blocks the light path of the optical sensor S1 when pivotally moved by the sheet. This enables the sensor to detect various sheets including transparent sheets without impairing the advantage of eliminating the need to wire the discharging unit 6.

Figure 6:
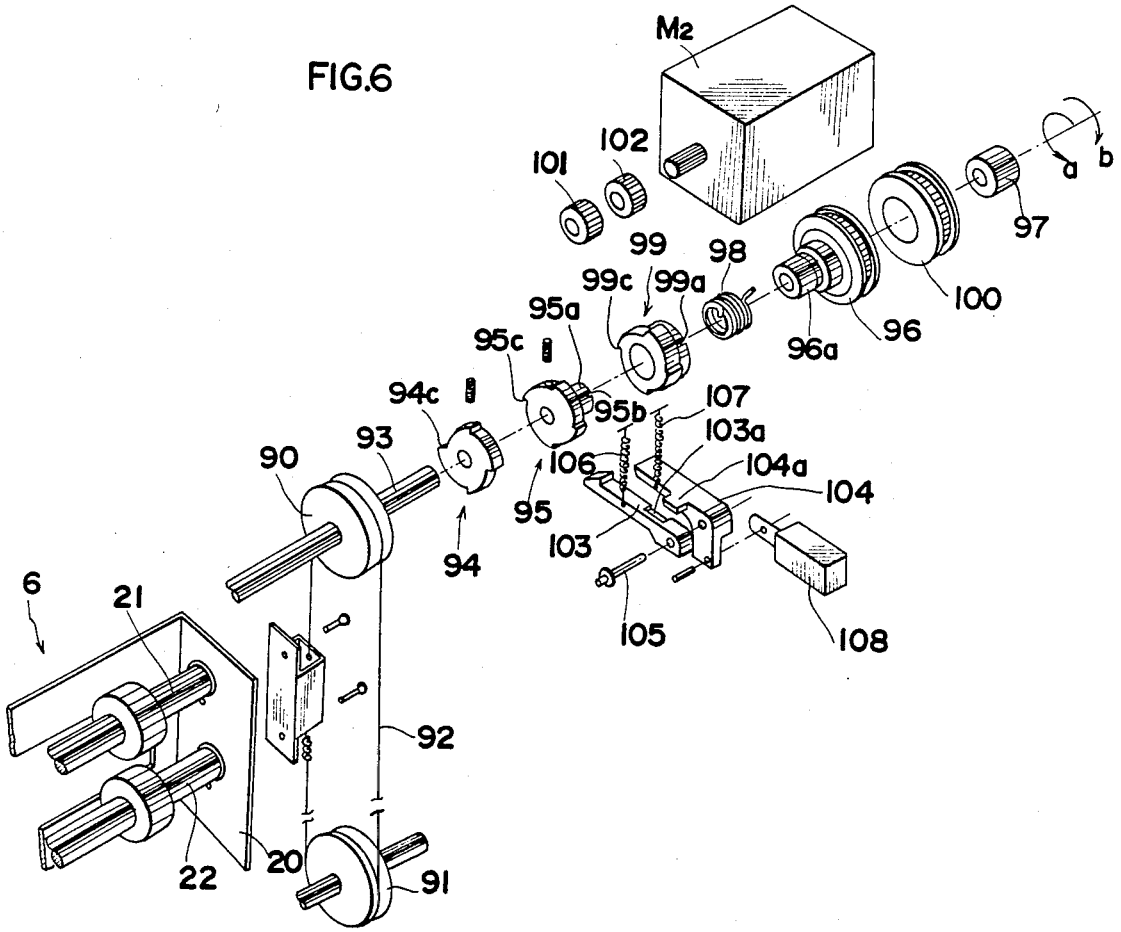
FIG. 6 is an exploded perspective view showing a mechanism for driving the discharging unit.

FIG. 6 shows a mechanism for intermittently moving, fixedly positioning and returning the discharging unit 6. The frame 20 of the unit 6 is secured to a wire 92 reeved around pulleys 90 and 91 disposed at upper and lower portions of the sorter. A shaft 93 for the pulley 90 is fixedly provided with a first positioning member 94, a second positioning member 95 and a one-way clutch 97 and carries a forward rotation pulley 96 idly rotatable thereon. A kick spring 98 is wound around a boss portion 95*a* of the second positioning member 95 and around a boss portion 96*a* of the forward rotation pulley 96, with a clutch collar 99 loosely fitted around the spring 98. The kick spring 98 has one end engaged in a cutout 95*b* of the second positioning member 95 and the other end engaged in a cutout 99*a* of the clutch collar 99. A reverse rotation pulley 100 is attached to the one-way clutch 97. The forward rotation pulley 96 and the reverse rotation pulley 100 are respectively coupled to pulleys 101 and 102 on the shaft of a reversible motor M2 by unillustrated belts. The term "forward rotation" herein used refers to rotation in the direction designated by a in FIG. 6 for intermittently moving the discharging unit 6. The term "reverse rotation" refers to rotation in the reverse direction indicated at b in FIG. 6 for returning the unit 6. The first and second positioning members may be formed integrally.

The second positioning member 95 and the clutch collar 99 are provided on their periphery with contact portions 95*c* and 99*c*, respectively, equidistantly spaced apart and oriented in the same direction circumferentially thereof. On the other hand, the first positioning member 94 is provided on its periphery with contact portions 94*c* oriented in the opposite direction. A first latch member 103 is engageable with the contact portions 94*c* of the first positioning member 94, and a second latch member 104 with the contact portions 95*c*, 99*c* of the second positioning member 95 and the clutch collar 99. The first and second latch members 103, 104 are biased by springs 106, 107, respectively, in a direction to engage the corresponding contact portions. The second latch member 104 is connected to a solenoid 108, which, when energized, moves the second latch member 104 out of engagement with the contact portion. The second latch member 104 has a projection 104*a*, while the first latch member 103 has a recess 103*a* positioned in corresponding relation to the projection 104*a*.

When the second latch member 104 is retracted to a disengaged position by the solenoid 108 upon the energization thereof, the first latch member 103 retracts to the disengaged position following the second latch member 104 since the projection 104*a* of the member 104 is in engagement with the recessed portion 103*a* of the member 103.

The discharging unit 6 is intermittently moved, fixedly positioned and returned by the foregoing mechanism. For the intermittent movement, the motor M2 rotates in the forward direction, and the rotation is delivered from the pulley 101 to the forward rotation pulley 96. During the intermittent movement, the solenoid 108 is on, holding the first and second latch members 103, 104 in the disengaged position, so that the kick spring 98 is not restrained by the clutch collar 99. Consequently the kick spring 98 is tightened up to connect the boss portion 96*a* of the forward rotation pulley 96 to the boss portion 95*a* of the second positioning member 95. Thus the torque from the motor M2 is transmitted from the shaft 93 to the discharging unit 6 via the pulleys 90, 91 and the wire 92.

Figure 7:
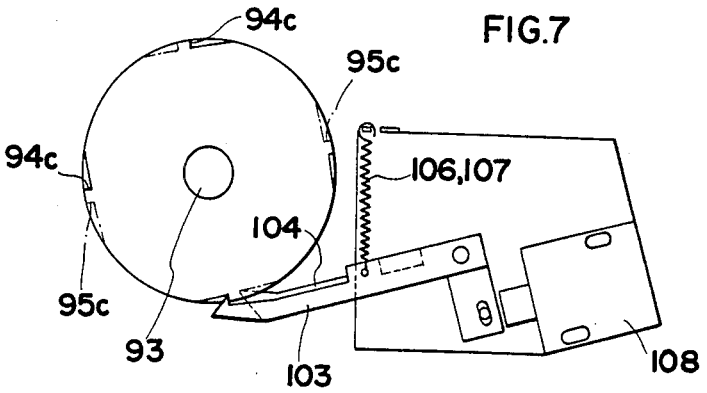
FIG. 7 is a view showing latch members illustrated in FIG. 6 when they are in engagement with positioning members.

The intermittent movement is completed by a signal which is emitted by unillustrated means and which indicates that the disengaging unit 6 has reached the position opposed to the next bin. Upon the emission of the signal, the solenoid 108 is deenergized, whereupon the first and second latch members 103, 104 are brought into an engaging position. The second latch member 104 engages one of the contact portions 99*c* to stop the rotation of the clutch collar 95 and loosen the kick spring 98, whereby the transmission of the torque of the motor M2 is discontinued. At the same time, the first and second latch members 103, 104 come into engagement with the first and second positioning members 94, 95 as shown in FIG. 7, thereby locking the shaft 93 against rotation in both forward and reverse directions. Consequently the discharging unit 6 is also locked. The locking of the discharging unit 6 in its stopped position results in the advantage that for example when a jamming sheet is to be removed, the unit 6 is not subject to displacement, permitting the sorting operation to be resumed in the proper sequence. To unlock the unit 6, the solenoid 108 is energized.

When returning the unit 6, the reversible motor M2 rotates in the reverse direction. The rotation is delivered from the pulley 102 to the shaft 93 via the unillustrated belt, the reverse rotation pulley 100 and the one-way clutch 97 which is adapted to transmit the reverse rotation only. At this time, the solenoid 108 is held energized.

The endless belts 60 are driven by the following means for the transport of sheets. The sheets can be transported by the sorter selectively at one of two speeds, i.e. a first speed equal to the copying speed of the copying machine, and a second speed higher than the first speed. The sheet is transported at the first speed when the leading end of the sheet has been detected by a discharge sensor S0 in the copying machine. Upon the sensor S0 detecting the rear end of the sheet, the sheet is transported at the second speed. The first speed of the sorter is further selectable from three different speeds, such that the speed is preselected in conformity with the copying speed of the machine.

The speed of transport of the sheet in the sorter is usually much higher than the sheet transport speed of the copying machine, so that unless the speed is selected and changed as above, the sheet will slip relative to the transport means of one or both of the copying machine and the sorter while being transferred from the machine to the sorter. The copy image formed on the surface of the sheet will then be disturbed or damaged and become defective.

Figure 8:
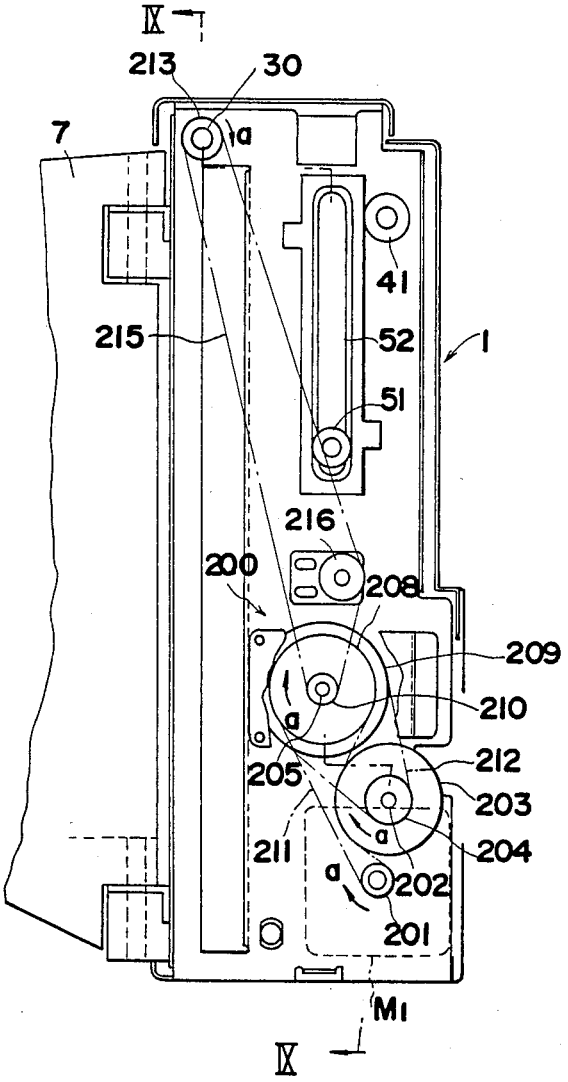
FIG. 8 is a side elevation showing a mechanism for driving endless belts as the sorter is seen from the other side thereof in opposite relation to FIG. 1.
Figure 9:
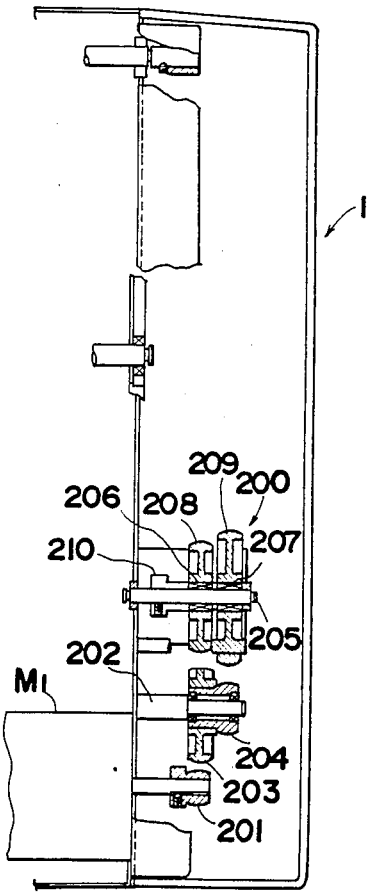
FIG. 9 is a view in section taken along the line IX—IX in FIG. 8.

With reference to FIGS. 8 and 9, the speed is changed by a reversible motor M1 which is adapted to have two poles or four poles selectively, and a change mechanism for changing the reduction ratio according to the direction of rotation of the motor M1. The endless belts 60 are driven by drive means 200 provided with the motor M1 and the change mechanism. The motor M1 and the drive means 200 are mounted on the side plate at the remote side of the sorter in FIG. 1.

Stated more specifically the sorter 1 has in its interior an output pulley 201 for the motor M1, a pulley 204 rotatably mounted on a shaft 202, a pulley 203 attached to the pulley 204, pulleys 208, 209 mounted on a rotatable intermediate shaft 205 with one-way clutches 206, 207 provided therebetween, and a pulley 210 fixedly mounted on the intermediate shaft 205. A belt 211 is reeved around the pulleys 201, 208, and a belt 212 around the pulleys 204, 209. A belt 215 is further reeved around the pulley 210 and a pulley 213 fixedly mounted on the shaft 30 for the rollers 31. The belt 211 is partly pressed into contact with a side portion of the pulley 203 to drive the pulley 203. A tension roller 216 is elastically pressed into contact with the belt 215 from inside to hold the belt 215 in tension at all times. The one-way clutches 206, 207 transmit torque to the intermediate shaft 205 only when the pulleys 208, 209 are driven in the direction of arrow a (clockwise) in FIG. 8.

When the motor M1 is driven in the forward direction, the output pulley 201 rotates in the direction of arrow a to rotate the pulley 208 in the direction of arrow a through the belt 211. The rotation is transmitted through the one-way clutch 206 and the intermediate shaft 205 to the pulley 210, which in turn rotates the pulley 213 in the direction of arrow a through the belt 215. The rotation is delivered from the shaft 30 to the rollers 31 to drive the endless belts 60. Although the travel of the belt 211 rotates the pulley 203 in a direction opposite to the direction of arrow a, causing the pulley 204 to rotate the pulley 209 in the opposite direction through the belt 212, the pulley 209 rotates independently of the intermediate shaft 205 by virtue of the provision of the one-way clutch 207.

When the motor M1 is driven in the reverse direction, the output pulley 201 rotates in the opposite direction to the arrow a to cause the belt 211 to rotate the pulley 203 with the pulley 204 in the direction of arrow a, further causing the belt 212 to rotate the pulley 209 in the direction of arrow a. The rotation is transmitted to the pulley 210 through the one-way clutch 207 and the intermediate shaft 205. In the same manner as in the case of forward rotation described, the rotation is transmitted through the belt 215, the pulley 213 and the shaft 30 to the rollers 31 to drive the endless belts 60. The rotation of the belt 211 rotates the pulley 208 in the opposite direction to the arrow a independently of the intermediate shaft 205 since the one-way clutch 206 is provided between the pulley 208 and the shaft 205.

The reverse rotation of the motor M1 produces a speed reduction which is greater than is achieved by the forward rotation by an amount corresponding to the pulley 203. The reduction ratio is about 1:0.34 according to the present embodiment. Furthermore the motor M1 is changeable for two-pole rotation or four-pole rotation alternatively, consequently affording the following four different speeds selectively.

Figure 10:
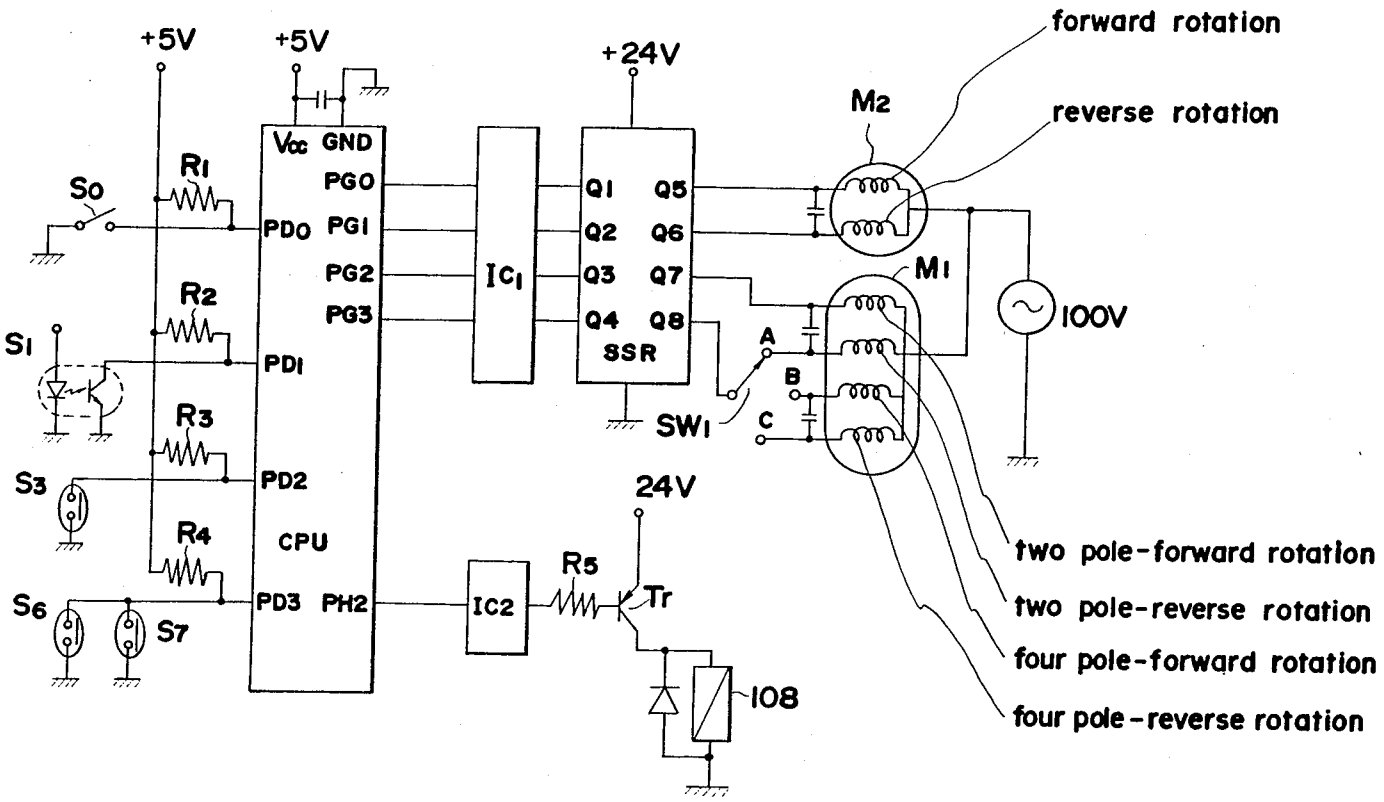
FIG. 10 is a diagram showing a circuit for driving the sheet transporting assembly and the discharging unit.

Two-pole forward rotation: 750 mm/sec
Two-pole reverse rotation: 260 mm/sec
Four-pole forward rotation: 375 mm/sec
Four-pole reverse rotation: 130 mm/sec FIG. 10 shows a control circuit including a changeover switch SW1 having a contact A for two-pole reverse rotation, a contact B for four-pole forward rotation and a contact C for four-pole reverse rotation. The switch SW1 is preset according to the copying speed of the machine 2. With the illustrated embodiment, the contact A is closed for two-pole reverse rotation at 260 mm/sec as the first speed.

The common terminal of the switch SW1 is connected to an output terminal Q8 of a solid state relay SSR. The two-pole forward rotation terminal for giving the second speed is connected to an output terminal Q7 of the relay. The motor M2 for moving the discharging unit 6 upward or downward is connected to output terminals Q5, Q6 of the relay SSR. A microcomputer CPU has input ports PD0, PD1, PD2, PD3 connected to a 5-volt power supply via resistors R1, R2, R3, R4 and grounded via normally open contacts of the discharge sensor S0 of the copying machine 2, the gate sensor S1, a home position sensor S3 and overrun sensors S6, S7. The microcomputer CPU has output ports PG0, PG1, PG2, PG3 which are connected via a driver IC1 to input terminals Q1, Q2, Q3, Q4 of the relay SSR. The microcomputer further has an output port PH2 which is connected via a driver IC2 and a resistor R5 to the base of a transistor Tr, which has an emitter connected to a power supply and a collector connected to a solenoid 108 for positioning the discharging unit 6 in corresponding relation to each bin.

The home position sensor S3, which is adapted to detect whether or not the discharging unit 6 is positioned for the top bin 8, feeds an ON signal to the input port PD2 only when the unit 6 is located in the home position. The overrun sensors S6, S7 detect overrun and over-retraction of the discharging unit 6 when it is driven stepwise. Only upon detecting such an excessive movement, the sensors feed an ON signal to the input port PD3 to stop the sorter in its entirety. For this purpose, the sorter main body is provided at specified locations with reed switches which are energized by a permanent magnet mounted on the discharging unit 6. The home position sensor S3 comprises similar elements.

On the other hand, the discharge sensor S0 gives an ON signal (detecting the leading end of a sheet) to the input port PD0, whereupon the output terminal Q8 of the relay SRR is closed, bringing the motor M1 into two-pole reverse rotation and causing the drive means 200 to drive the endless belts 60 at the first speed. Further when an OFF signal (detecting the rear end of the sheet) is fed from the discharge sensor S0 to the input port PD0, the output terminal Q7 of the relay SSR is closed instead of the terminal Q8 to bring the motor M1 into two-pole forward position, causing the drive means 200 to drive the endless belts 60 at the second speed.

When the sheet is delivered from the discharging unit 6 into the specified bin at the second speed, the gate sensor S1 emits an OFF signal (detecting the rear end of the sheet), whereupon an internal timer of the microcomputer CPU provides a predetermined time delay. The output terminal of the relay SSR is then changed over from Q7 to Q8 to bring the motor M1 into two-pole reverse rotation at the lower speed in preparation for the transport of the next sheet. A copy number signal from the copying machine 2 is fed to the microcomputer CPU. If the signal is "1", another timer subsequently provides a predetermined time delay, and the output terminal Q8 of the relay SSR is thereafter turned off to stop the motor M1.

If the copy number signal from the copying machine 2 is larger than "1", a timer affords a predetermined time delay in response to the aforementioned OFF signal (detecting the rear end of the sheet) from the gate sensor S1, whereupon the output terminal Q5 of the relay SSR is turned on to bring the motor M2 into forward rotation. At the same time, the output from the output port PH2 is changed to "H" to turn on and off the solenoid 108 and move the discharging unit 6 by one step. After a number of sheets have been distributed as specified by the copy number signal by moving the distributing unit 6 stepwise through the repetition of the above procedure, the output terminal Q5 is changed over to the terminal Q6 to bring the motor M2 into reverse rotation and, at the same time, the solenoid 108 is energized. Consequently the discharging unit 6 returns upward. This is detected by the home position sensor S3, which changes the input port PD2 to "L", whereupon the solenoid 108 is deenergized. After a predetermined time delay given by a timer, the output terminal Q6 is changed over to the terminal Q5 to bring the motor M2 into forward rotation. After a predetermined time delay afforded by another timer, the output terminal Q5 is turned off to stop the motor M2.

If the discharging unit 6 is not in the home position (i.e. if the home position sensor S3 is off) when the microcomputer CPU is initialized by turning on the power supplies for the copying machine 2 and the sorter 1, the output port PH2 delivers "H" output to energize the solenoid 108, while the output ports PG0 to PG3 deliver 4-bit signals (with PG1 only remaining "L") to turn on the output terminal Q6 of the relay SSR and bring the motor M2 into reverse rotation, thereby moving the discharging unit 6 to the home position. Upon the unit 6 reaching the home position, the sensor S3 functions to change the input port PD2 from "H" to "L", thereby changing the output port PG1 to "H" to stop the motor M2 and also changing the output port PH2 to "L" to deenergize the solenoid 108, whereby the unit 6 is placed in the home position.

Figure 17A:
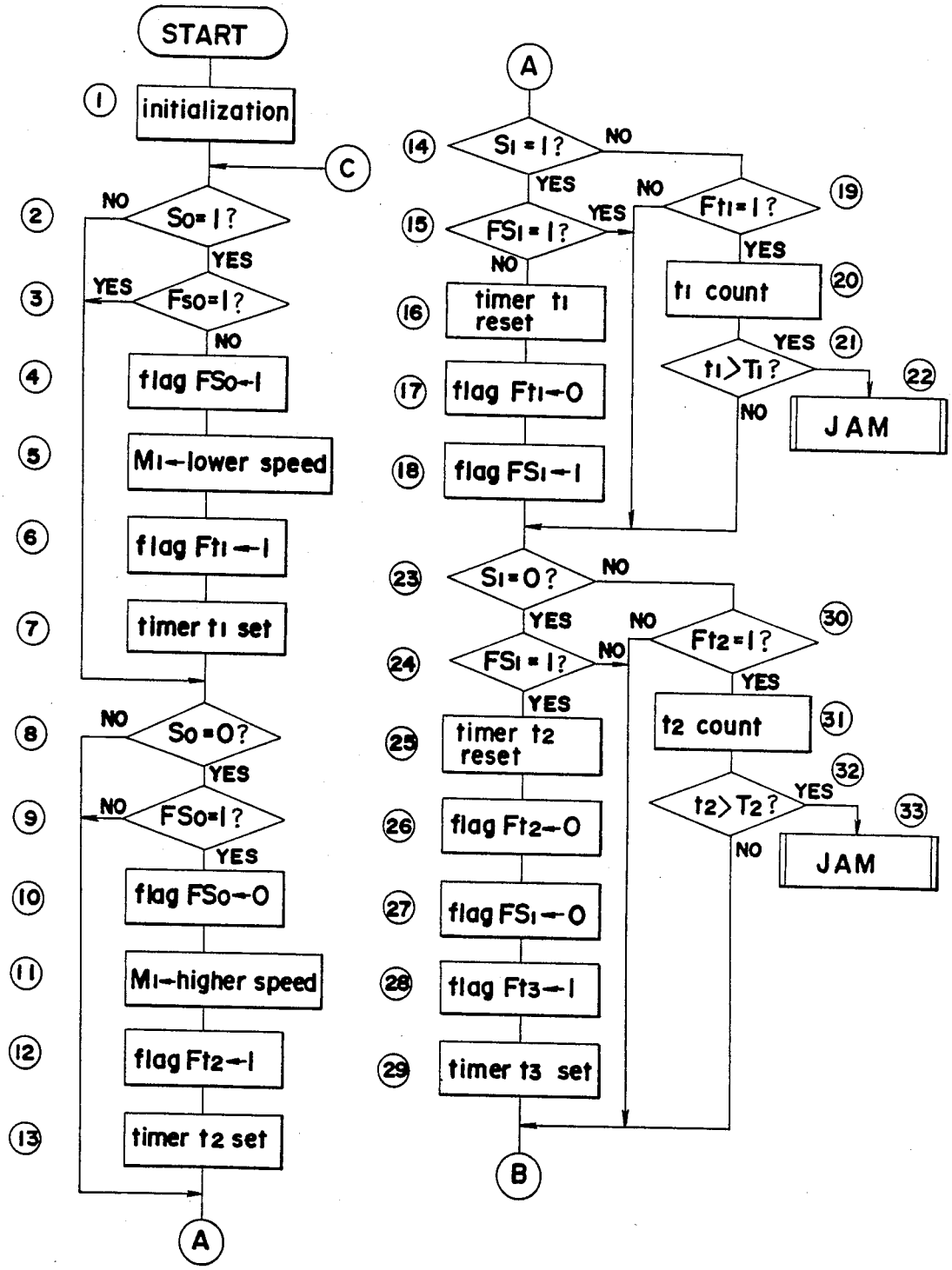
FIGS. 17A and 17B are flow charts showing processing steps for executing control by the microcomputer CPU shown in FIG. 10.
Figure 17B:
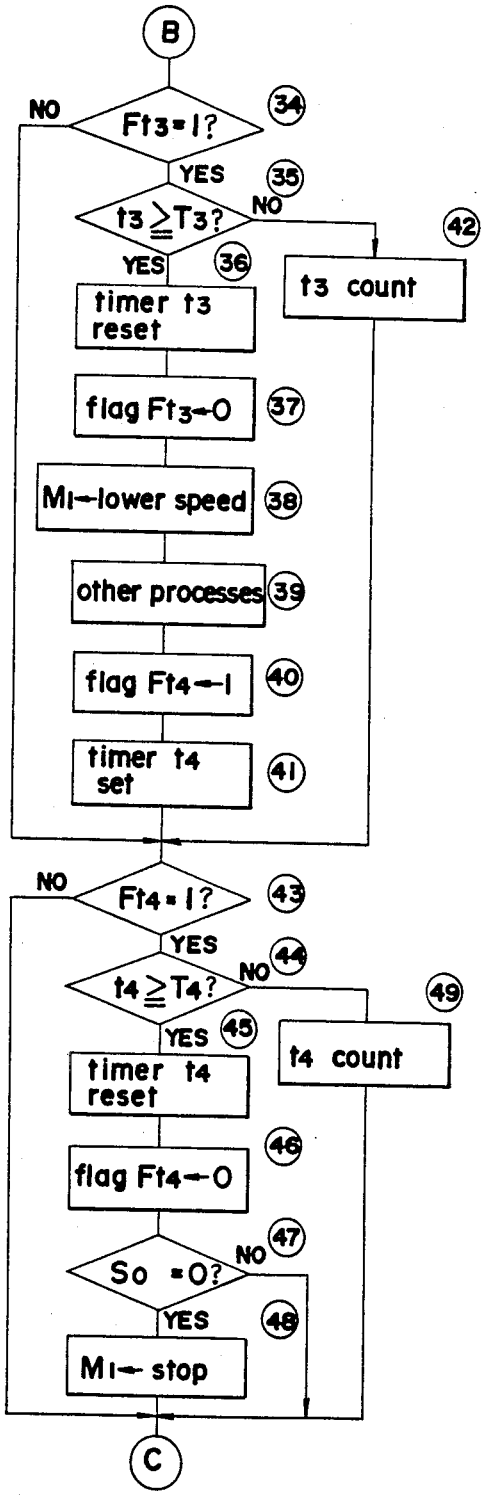

The changeover of belt driving speed discussed above is executed by the microcomputer CPU in accordance with processing steps of flow charts shown in FIGS. 17A and 17B. The flow charts further contain the steps on the jam processing while the movement of the discharging unit is simplified as it is easy to understand from the above discussed explanation.

These flow charts repeat circulatively in a cycle of several tens of second. The ON state in which the sensor S0 and S1 gives an ON signal is shown as "1" and similarly the OFF state in which the sensor S0 and S1 gives an OFF signal is shown as "0". The flags FS0 and FS1 are flags which are programmed to become "1" when corresponding sensor becomes ON state and to become "0" when corresponding sensor becomes OFF state. All the timers shown in the flow charts are digital timers which are programmed to count up for every routine of the process by the microcomputer CPU. The flags $Ft_1$, $Ft_2$, $Ft_3$ and $Ft_4$ are flags which are programmed to become "1" when a corresponding timer is set and to become "0" when the count of the timer is larger than the numerical value predetermined for the corresponding timer respectively.

With reference to FIG. 17A, step 1 is performed for initialization when the power supply is turned on for the sorter. The initialization is performed automatically according to the data stored in a memory of the microcomputer to control the sorter, for example, so as to reverse the discharging unit 6 to the start position when the discharging unit 6 is absent from the start position.

Steps 2 to 7 are performed to change the speed of the motor M1 to the lower speed (the first speed described above) in accordance with the detection of the leading end of the sheet by the discharge sensor S0.

Steps 8 to 13 are performed to change the speed of the motor M1 to the higher speed (the second speed described above) in accordance with the detection of the rear end of the sheet by the discharge sensor S0.

Steps 14 to 22 are performed to dispose of jam processing, if the timer $t_1$ which is set in step 7 counts over the predetermined numerical value $T_1$.

Steps 23 to 33 are performed to dispose of similar jam processing, if the timer $t_2$ which is set in step 13 counts over the predetermined numerical value $T_2$.

Steps 34 to 42 are performed to change again the speed of the motor M1 to the lower speed after the delay by the timer $t_3$ which is set in step 29. The other processes in step 39 contain a process for moving the discharging unit 6.

Steps 43 to 49 are performed to stop the motor M1 on condition that no sheet is detected by the sensor S0 after the delay by the timer $t_4$ which is set in step 41.

Figure 11:
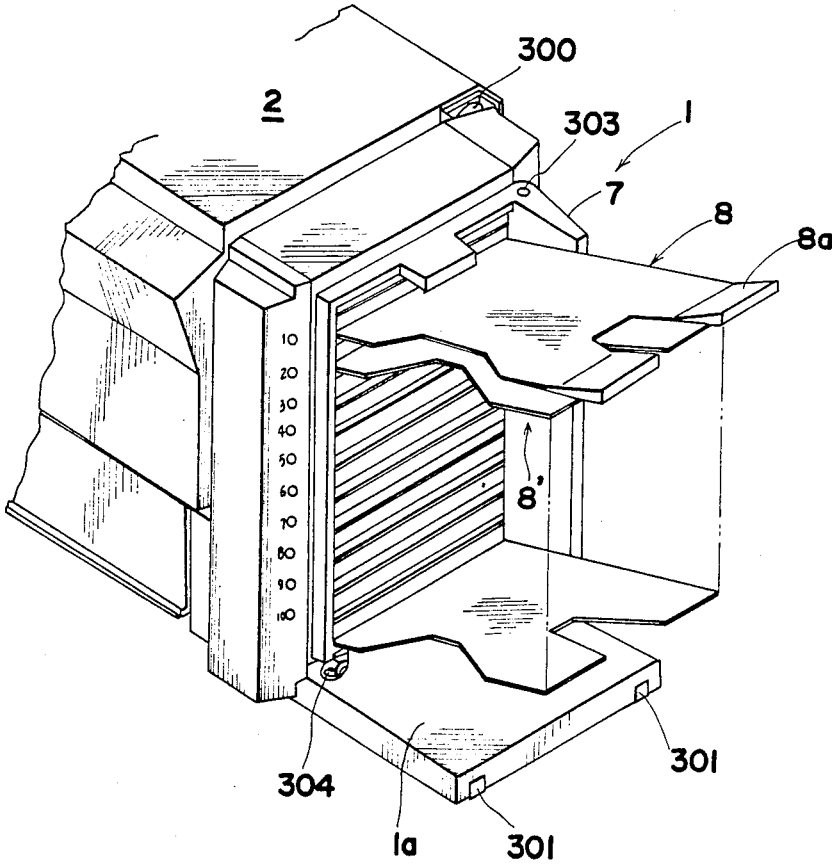
FIG. 11 is a perspective view showing the sorter of the invention.

FIG. 11 is a perspective view showing the sorter 1 attached to the copying machine 2. The sorter 1 is supported by and movable about a vertical pivot 300 attached to the copying machine 2. The sorter 1 has a base portion 1*a* which is provided on its bottom with rollers 301 for assisting the pivotal movement of the sorter. When the sorter 1 is attached to the machine 2 completely, the sorter 1 is held connected to the machine by a lever, magnet or like means. The bins 8, 8', . . . are held to the bin assembly 7 which, as in the relation of the sorter 1 to the copying machine, is supported by and movable about a vertical pivot 303 fixed to the sorter main body and is movable on the base portion 1*a* assisted by a roller 304. This arrangement is useful for remedying jams and also for maintenance and inspection.

Figure 12:
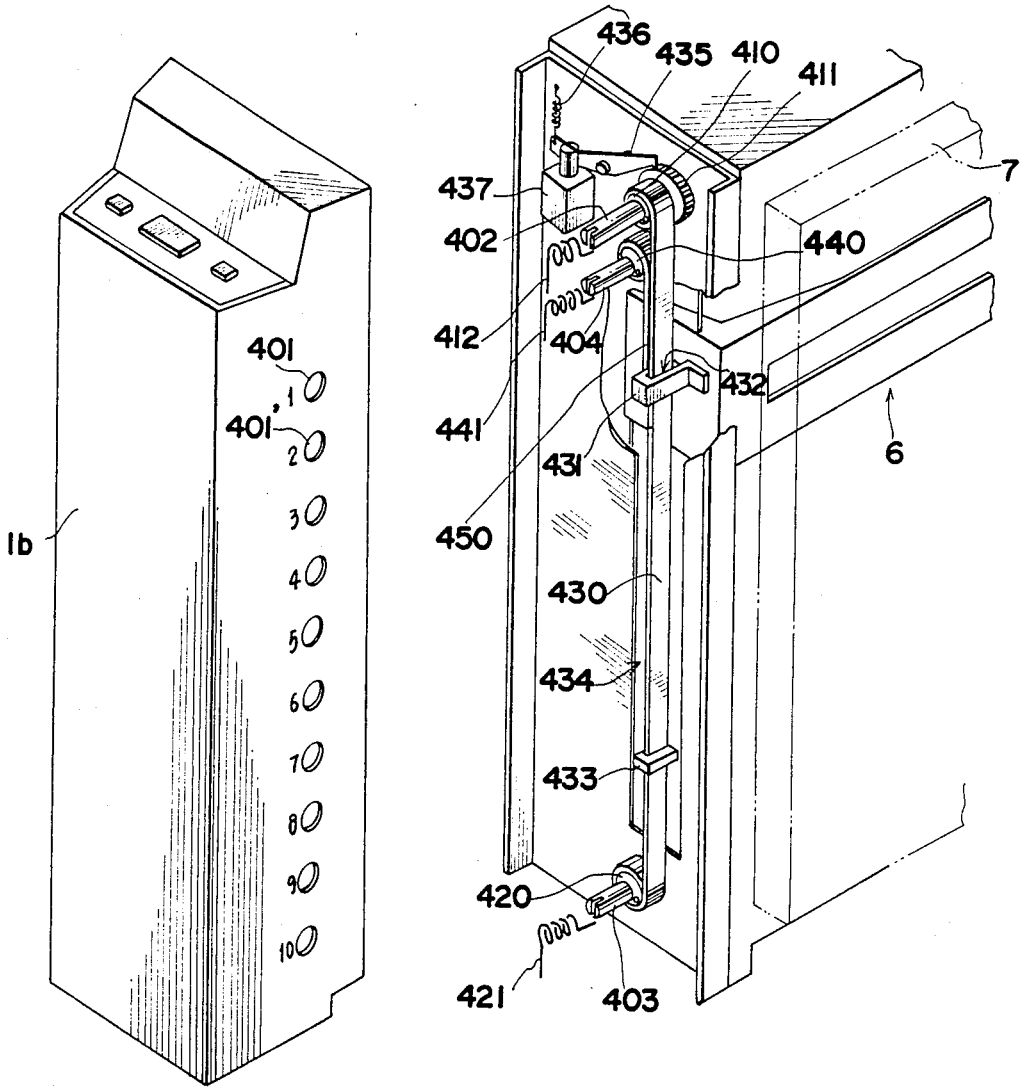
FIG. 12 is a perspective view showing a bin indicating mechanism.
Figure 13:
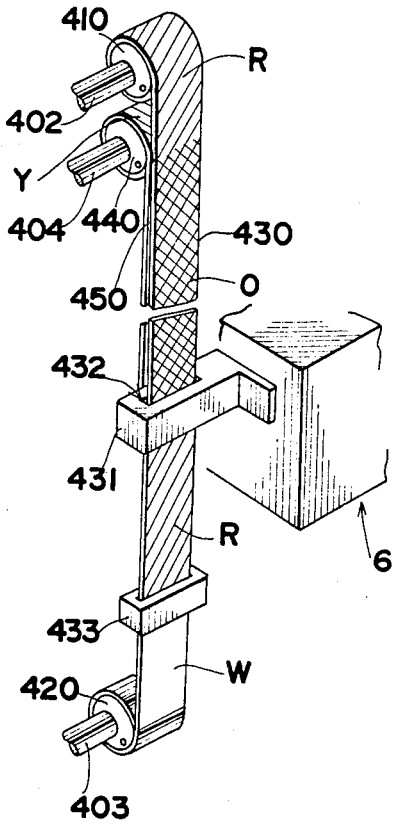
FIG. 13 is an enlarged fragmentary view showing the same.

The sorter 1 is further provided with a mechanism for indicating the number of bins specified, i.e., to be used, and the bins which are included in the specified bins and into which sheets have already been placed and the other bins of the specified ones into which sheets are to be placed or, in other words, the position of the discharging unit 6. With reference to FIG. 12, FIG. 13 and FIGS. 14A, B and C, FIG. 12 shows the mechanism with a cover 1*b* removed from the sorter main body. The cover 1*b* is formed with a plurality of indicating windows 401, 401', . . . positioned in corresponding relation to the bins 8, 8', . . . and marked with corresponding numbers. The side plate of the main body inside the cover is fixedly provided with take-up shafts 402, 403, 404. A tape take-up member 410 and a ratchet 411 integral therewith are idly rotatably mounted on the take-up shaft 402. The tape take-up member 410 is biased counterclockwise by a spring 412 having one end engaged in a side hole of the member 410 and the other end engaged in a groove of the shaft 402. Similarly the take-up shaft 403 has a tape take-up member 420 idly rotatably mounted thereon which is biased clockwise by a spring 421 having one end engaged in a side hole of the member 420 and the other end engaged in a groove of the shaft 403.

A first indicating tape 430 is wound around the take-up members 410, 420 and has its opposite ends secured to these members 410, 420 individually. The tape 430 is suitably pulled upward and downward by being biased by the springs 412, 421 counterclockwise and clockwise. Since the force of the spring 412 is greater than that of the spring 421, the tape 430 is usually biased to be wound around the take-up member 410. The indicating tape 430 extends through a guide bore 432 formed in a guide member 431 fixed to the discharging unit 6. A stop 433 is secured to a portion of the tape 430 which portion is positioned toward the take-up member 420 from the guide member 431. The stop 433 can be brought into contact with the bottom of the guide member 431. The guide member 431 extends outward through a slit 43 formed in the side plate.

A lever 435 for restraining the take-up member 410 from rotation is in engagement with the ratchet 411. Although biased into engagement with the ratchet 411 by a spring 436, the lever 435 is disengaged from the ratchet 411 by the energization of a solenoid 437 mounted on the sorter main body.

A tape take-up member 440 is freely rotatably mounted on the take-up shaft 404 and biased counterclockwise by a spring 441 which has one end engaged in a side hole of the member 440 and the other end engaged in a groove of the shaft 404. A second indicating tape 450 is wound on the take-up member 440 and has one end secured to the member 440 and the other end secured to the guide member 431.

With reference to FIG. 13, the indicating tapes 430, 450 of the present embodiment are made of a transparent or semitransparent material, such as polyethylene film or triacetate film. A red (R) tape is used for the upper segment of the tape 430 above the stop 433, and a white (W) tape for the lower segment below the stop 433. A yellow (Y) tape is used as the tape 450. The portion of the tape 430 overlapping the tape 450 (i.e. crisscrossed portion shown) appears orange (O) owing to the combination of red (R) and yellow (Y).

The colors of the indicating tapes 430, 450 are not limited to those mentioned above but may be any colors that can be clearly distinguished visually. Fluorescent coatings are useful for color identification in the dark. The tape 450 may be an opaque tape. If the tapes 430, 450 are arranged in opposite relation to the above, the tape 430 may be an opaque tape.

Figure 14:
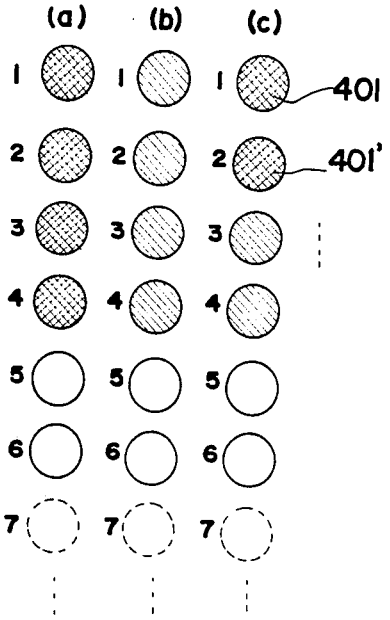
FIG. 14 is a diagram illustrating a bin indicating method.

The bins are indicated in the manner described below with reference to FIG. 14.

In the initial state, the solenoid 437 is unenergized, with the tape 430 wound up and biased upward due to the difference between the forces of the springs 412, 421, so that the stop 433 is in contact with the guide member 431. At this time, the indicating windows 401, 401', . . . all appear white (W), indicating that none of the bins are used for sorting or collation.

When the operator brings the copying machine into operation with the sorter in condition for operation, the sorter receives sheets from the machine, and the discharging unit 6 intermittently moves to deliver the sheets one by one into a specified number of bins. With the intermittent movement of the discharging unit 6, the indicating tape 450 is pulled out from the take-up member 440, while the stop 433 is moved downward by being pushed by the guide member 431 to pull the indicating tape 430 from the take-up member 410. At this time, the indicating windows 401, 401', . . . corresponding to the bins having a group of sheets placed therein as individually distributed thereto appear orange (O) owing to the overlapping of the tapes 430 and 450 as seen in FIG. 14A. This drawing shows that copy sheets for the first original have been distributed into the first to fourth bins for sorting.

After the discharging unit 6 has moved to the position of the bin corresponding to the number of copies specified for the first original, the unit 6 returns to the home position in response to a return signal, but the take-up member 410 is prevented from winding up the indicating tape 430 by the engagement of the lever 435 with the ratchet 411.

On the other hand, the indicating tape 450 is wound on the take-up member 440 with the return of the discharging unit 6, so that the color of the indicating windows for the first bin to the bin corresponding to the specified number of copies changes to red (R), with the other indicating windows remaining white (W) as shown in FIG. 14B. Thus the bins in use for sorting can be distinguished from the bins not used for sorting by the different colors.

When the discharging unit 6 is brought into intermittent movement again, the indicating windows for the bins having sheets delivered thereto appear orange (O) due to the overlapping of the tapes 430 and 450 as seen in FIG. 14C. This drawing shows that copy sheets for the second original have been placed into the first and second bins. Thus the bins having the sorted sheets placed therein can be manifestly distinguished from the bins into which sheets are to be subsequently placed for sorting. The bins in use for sorting can also be distinguished from those not in use for sorting.

After the prescribed number of copy sheets of every original have been completely sorted by the reciprocation of the discharging unit 6 for the bins in use for sorting, the solenoid 437 is energized in response to a signal for returning the unit 6 to the home position, disengaging the lever 435 from the ratchet 411. The stop 433 is brought into contact with the guide member 431 by the action of the spring 412 and returned to the home position along with the unit 6. Consequently the indicating windows 401, 401', . . . for the bins used for sorting turn white (W), indicating that none of the bins are now in use. The indication shows the operator that the sorting operation has been completed.

The present embodiment can be so controlled that when the number of copies to be sorted for each original is set, the tape take-up member 420 is rotated clockwise by energizing a motor with the setting signal to change the color of the indicating window 401, 401', . . . for the bins corresponding in number to the copy number to red (R) and thereby indicate the bins to be used for sorting. Further although the embodiment is adapted to indicate the sorting bins in colors for discrimination, characters or patterns are alternatively usable for indication.

With reference to FIG. 1, the uppermost bin, i.e., the top bin 8 is larger than the other bins 8', . . . therebelow and is raised at its forward end 8*a* for the following reason. Generally sorters have a sorting mode in which sheets are distributed into bins for sorting, and a non-sorting mode in which all sheets are discharged onto a single tray. With the sorter of the present embodiment, the top bin 8 serves as the tray to be used in the non-sorting mode and is of course used also in the sorting mode. Accordingly various sheets such as sheets of larger sizes or thicknesses that can not be handled in the sorting mode are discharged onto the top bin 8. However, such a sheet of larger size or thickness has a greater momentum than the standard sheet when it is discharged, so that the sheet jumps greatly upon discharge. If the bin is of usual size, the sheet will then project outward at its leading end from the bin in a drooping posture, falling to return to the interior of the bin neatly in register with other sheets. To avoid this, the top bin 8 has a length L larger than the length of the other bins 8', . . . and is provided with a raised portion 8*a* at its forward end beyond the length L' of the largest standard size for use in the sorting mode. Such raised portion or portions 8*a* give resistance to the sheet leading end, attenuating the momentum to enable the sheet to return onto the bottom of the bin. The raised portion 8*a* may be in the form of a rib or may be formed merely by bending the bin end upward. Furthermore the top bin 8 has a depth D larger than that of the other bins 8', . . . so as to accommodate a larger quantity of sheets. A sensor S2 is provided above the top bin 8 for detecting the presence or absence of a sheet in the top bin 8. When sheets are removed from the top bin 8, the sensor functions to initialize the control data for the sorter and permit the subsequent sorting operation.

Figure 15:
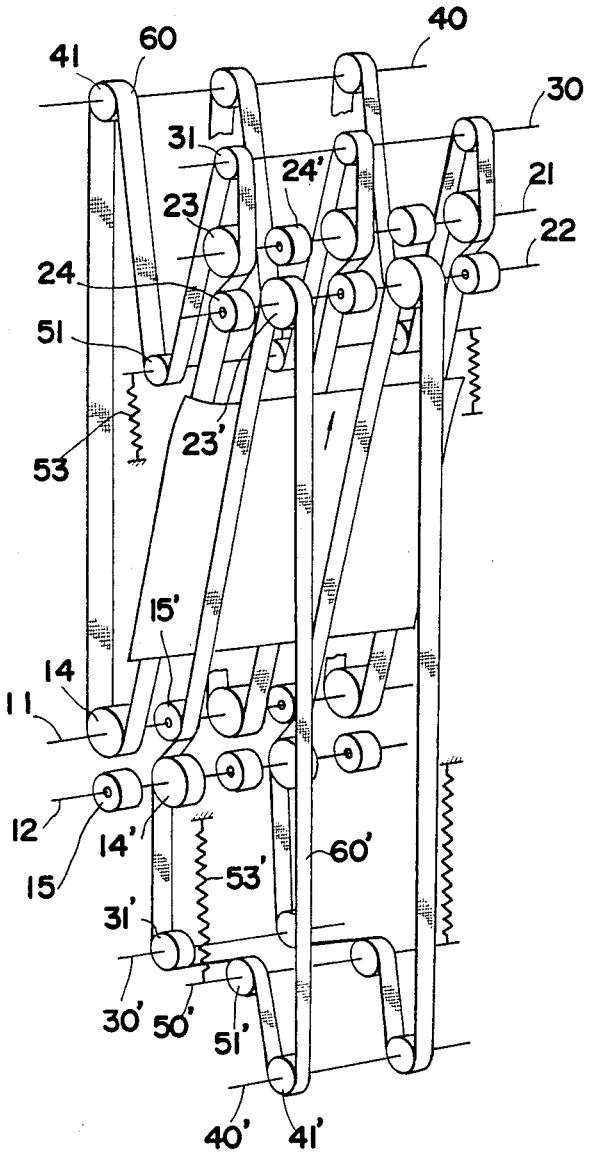
FIG. 15 is a perspective view schematically showing a modification of the sheet transporting assembly.

FIG. 15 shows a modification of the transporting assembly. While one of the upper and lower belt members shown in FIG. 2 comprises endless belts and the other, retractable tapes, the modification includes an upper belt member comprising three endless belts and a lower belt member comprising two endless belts, the endless belts of the upper and lower members being arranged alternately. Since each of the endless belts is supported in tension by an arrangement having substantially the same construction as the corresponding arrangement shown in FIG. 2, the upper endless belts and related members are referred to by the same numerals as the corresponding parts shown in FIG. 2, and the lower endless belts and related members are referred to by the same numerals as the corresponding parts of FIG. 2, with a prime attached to each reference numeral.

Figure 16:
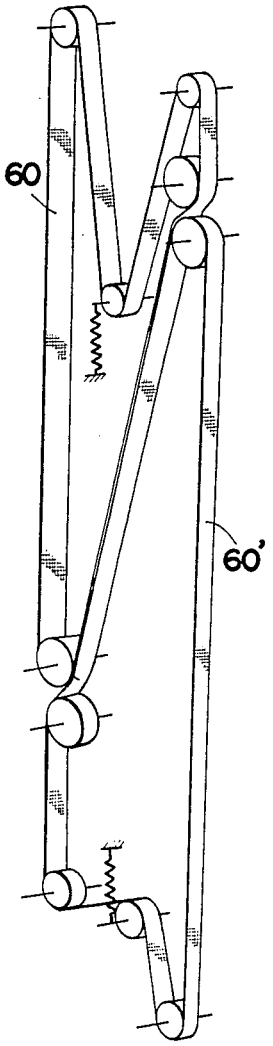
FIG. 16 is a perspective view schematically showing a further modification of the assembly shown in FIG. 15.

FIG. 16 shows a further modification of the above modification, in which upper endless belts are opposed to lower endless belts in contact with each other in pairs, although the drawing shows only one pair of upper and lower endless belts.

Figure 2:
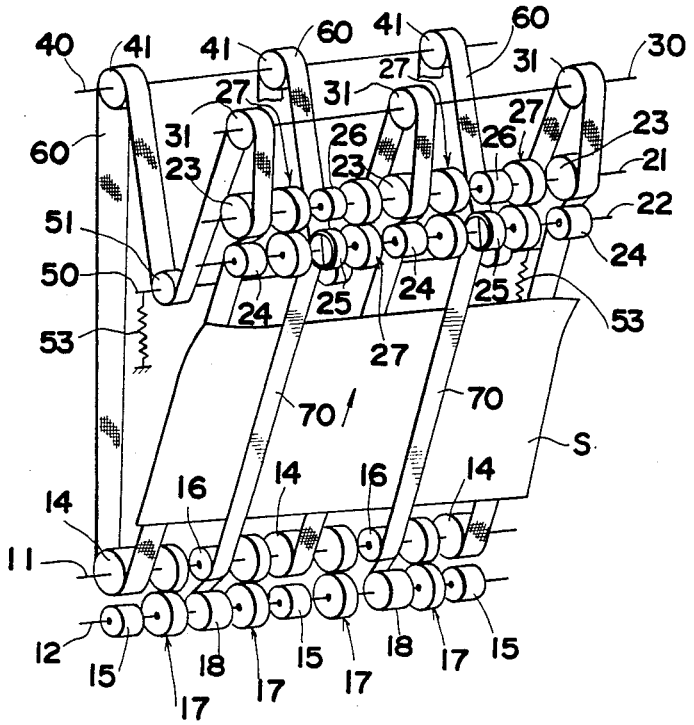
FIG. 2 is a perspective view schematically showing a sheet transporting assembly of the sorter of the present invention.

When the upper and lower belt members are each composed of endless belts and are both driven as in the modifications of FIGS. 15 and 16, the arrangement has improved ability to transport sheets but requires a space which is larger than that needed for the arrangement of FIG. 2 by an amount corresponding to the mechanism for holding the lower belt member in tension in its entirety. With the arrangement of FIG. 16, the sheet can be held between the belts with a greater force and therefore can be transported more effectively, but the arrangement requires an increased number of pairs of upper and lower endless belts.

Thus the belt members can be in various combinations for providing the transporting assembly, depending for example on whether endless belts or tapes are used and how the upper and lower belt members are arranged. Accordingly care should be taken to make the best choice from among the various combinations in accordance with the specifications of the sorter and the performance of the copying machine to be used in combination therewith.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A sorter of the type in which distributing means moves relative to a plurality of fixed bins along the inlets to the bins to thereby distribute individual sheets into the pins, said sorter comprising:

a pair of first shafts provided in the distributing means;

a pair of second shafts provided at the portion of the sorter in which the sheets are received from a copying machine;

a plurality of belt supporting rollers mounted on the upper one of said first and second shafts, respectively;

a plurality of tape supporting rollers mounted on the lower one of said first and second shafts, respectively;

a plurality of endless belts reeved around said belt supporting rollers mounted on both the upper one of said first and second shafts and a plurality of tapes reeved around said tape supporting rollers mounted on the lower one of both said first and second shafts, said endless belts and tapes being in alternating positions along said shafts;

a plurality of idle rollers mounted on each of said shafts and opposing said belts and tapes;

means engaging said endless belts for holding said endless belts in tension; and means for holding said tapes in tension, said tape tensing means comprising spring members attached to said tapes at the sheet receiving ends and the other ends being attached to said tape supporting rollers on the lower one of said first shafts, and spring means for rotatably biasing said tape supporting rollers to which the ends of said tapes are secured in a direction to wind said tapes around said tape supporting rollers.

2. A sorter as claimed in claim 1 wherein the surfaces of said endless belts having a greater coefficient of friction than the surfaces of said tapes.

3. A sorter of the type in which distributing means moves relative to a plurality of fixed bins along the inlets to the bins to thereby distribute individual sheets into the bins, said sorter comprising:

a pair of upper and lower shafts on the distributing means, and first upper roller member and a first lower roller member rotatably mounted on respective ones of said shafts;

a pair of second roller members fixedly mounted on the sorter for receiving sheets from a copying machine;

upper and lower belt members reeved around corresponding first and second roller members for receiving a sheet therebetween and transporting it between said belt members, said belt shafts being spaced along said roller members from each other with the upper belt members alternating with the lower belt members; and guide members idly rotatably mounted on said upper shaft and resting under gravity on at least one of the lower belt members and having a roll-shaped guide portion concentric with said upper shaft and a projecting portion extending therefrom in a direction opposite to the direction of transport of the sheet, said projecting portion having a slanting surface on the free end thereof slanting in said direction and away from said belt member for receiving the edge of a sheet thereunder even if the sheet has curled during transport, and said projecting portion further having a concave roll-shaped guide recess on the side toward said belt with a profile substantially the same as the periphery of the first lower roller member for guiding the edge of the sheet to the nip of the roll-shaped guide portion and the lower belt member where said lower belt member goes over said first lower roller member.

4. A sorter as claimed in claim 3 wherein the upper belt member is an endless belt and the lower belt member is a tape having its opposite ends fixed at the positions of the first and second roller members over which it is reeved, and means for holding said tape in tension between said last mentioned first and second roller members.

* * * * *